US006487982B2

(12) United States Patent
Takahashi et al.

(10) Patent No.: US 6,487,982 B2
(45) Date of Patent: Dec. 3, 2002

(54) ANTI-ROLLING STRUCTURE FOR BOX-TYPE FLOATING BODY

(75) Inventors: Toru Takahashi, Yokohama (JP); Yuji Awashima, Abiko (JP); Seiya Yamashita, Yokohama (JP)

(73) Assignee: Ishikawajima-Harima Jukogyo Kabushiki Kaisha, Tokyo-to (JP)

( * ) Notice: Subject to any disclaimer, the term of this patent is extended or adjusted under 35 U.S.C. 154(b) by 0 days.

(21) Appl. No.: 09/962,110

(22) Filed: Sep. 26, 2001

(65) Prior Publication Data

US 2002/0083877 A1 Jul. 4, 2002

(30) Foreign Application Priority Data

Nov. 15, 2000 (JP) ..... 2000-347963

(51) Int. Cl.[7] ..... B63B 9/08
(52) U.S. Cl. ..... 114/121; 114/122
(58) Field of Search ..... 405/26, 27, 30; 114/121, 122, 123, 125, 126

(56) References Cited

U.S. PATENT DOCUMENTS

| | | | | | |
|---|---|---|---|---|---|
| 1,136,306 | A | * | 4/1915 | Beck | 114/126 |
| 3,224,401 | A | * | 12/1965 | Kobus | 114/126 |
| 3,777,689 | A | * | 12/1973 | Olsen et al. | 114/267 |
| 4,341,177 | A | * | 7/1982 | Miyazaki et al. | 114/125 |
| 6,102,625 | A | * | 8/2000 | Olsen et al. | 114/122 |

FOREIGN PATENT DOCUMENTS

| | | | |
|---|---|---|---|
| JP | 6-247382 | * | 6/1994 |
| JP | 11-227683 | * | 11/1999 |

* cited by examiner

*Primary Examiner*—Stephen Avila
(74) *Attorney, Agent, or Firm*—Oblon, Spivak, McClelland, Maier & Neustadt, P.C.

(57) ABSTRACT

A floating body 1, which is substantially rectangular when seen from above, is provided with at least a protrusion 3 on at least either of sides in a transverse direction 5 of the floating body 1 at a level lower than a waterline 4.

9 Claims, 12 Drawing Sheets

ANTI-ROLLING STRUCTURE FOR BOX-TYPE FLOATING BODY

BACKGROUND OF THE INVENTION

The present invention relates to an anti-rolling structure for a box-type floating body such as a hull of a work-ship or -vessel or a hull for FPSO (Floating Production, Storage and Off-Loading).

In recent years, various new types of active anti-rolling systems for reducing roll motion of a hull in waves have been studied and some of them are already in practical use. Active anti-rolling systems are evidently superior to passive ones in terms of their roll reducing effect.

However, various active anti-rolling systems for reducing roll motion of hulls are generally complicated in structure, large-sized and heavy-weighted and require a large installation space. For reasons of economy and space, such systems are usually difficult to adopt for hulls.

Then, studies have been consequently made on passive anti-rolling systems which reduce roll motion by devising specifications and forms of hulls. A result of such studies was published in the bulletin of the Kansai Society of Naval Architects, extra volume with issue number 232 (September 1999). "Several studies on reducing roll motion in waves" (pp 63–70) is a paper of studies published in this bulletin. According to the paper, roll motion of box-type floating bodies can be reduced by adjusting height of the center of gravity. The content of the paper is now referred to below.

FIG. 1 shows an example of a box-type floating body 1 seen from the rear. The floating body 1 has a breadth B and a draft d. A center G of gravity of the floating body 1 is located near an origin O at which a waterline lies, or for example, a little above the origin O.

When the box-type floating body 1 as described above is subjected to beam seas, rolling motion 2 is generated which acts to rotate the floating body 1 around the center G of gravity.

The paper studies on reduction of roll motion of the box-type floating body 1 having a large ratio of the breadth B to the draft d (a large breadth/draft ratio) and argues that the roll motion can be reduced by shifting the position of the center G of gravity of the floating body 1.

Theoretical foundation of the study is an equation of motion with one degree of freedom for roll motion (rolling) having a synchronous influence on sway motion (swaying). Here the sway motion means a motion in which the box-type floating body 1 horizontally moves to right and left; and the roll motion, a motion in which the floating body 1 rotationally moves around the center G of gravity. An equation of motion with one degree of freedom, which is expressed in a more simple form, is useful in estimating a possibility of the reduction of roll motion.

An equation of motion with one degree of freedom for roll motion in which simultaneousness of the sway and rolling motions is considered is given as follows from an equation of synchronized motion of rolling and swaying:

$$\left[D_4 - \frac{D_{24}^2}{D_2}\right]\frac{X_4}{\zeta_A} = H_4 - \frac{D_{24}}{D_2}H_2 \tag{1}$$

where $X_4$ is an amplitude of the roll motion; $H_j$ (j=2, 4), the Kochin function; $D_j$ and $D_{24}$, coefficients that depend on hydrodynamic force; and j=2 and 4, the sway motion and the roll motion, respectively.

The right-hand side of Equation (1) is the wave exciting moment of roll motion in a broad sense, which includes influence from the sway motion. A relationship is formed as the equation below between the wave exciting moment of roll motion and effective wave slope coefficient γ.

$$\gamma \cdot GM = -i\frac{H_4 - (D_{24}/D_2)H_2}{K\nabla/(B/2)} \tag{2}$$

Next, define an added mass coefficient $k_2$ of sway motion, hydrodynamic force lever $l_2$ and wave exciting moment lever $l_w$, giving $$\left.\begin{aligned} k_2 &= m_{22}/\rho\nabla \\ l_2 &= -m_{24}/m_{22} \\ l_w/(B/2) &= -H_4/H_2 \end{aligned}\right\} \tag{3}$$

where $l_2$ and $l_w$ are distances measured from the center G of gravity of the box-type floating body 1 to the points where respective forces act and are defined as positive toward upwards.

With $l_{20}$ and $l_{wo}$ as moment levers being defined about the origin O, giving $$l(K)=k_2 l_{20}-(1+k_2)l_{wo} \tag{4}$$

When $$\gamma s=(i/K\nabla)\{H_2/(1+k_2)\} \tag{5}$$

holds, Equation (2) can be rewritten as $$\gamma \cdot GM=\gamma s\{OG-1(K)\} \tag{6},$$

where OG is distance from the origin O lying at the waterline to the center G of gravity and is defined as positive when the center G of gravity is located below the origin O; GM is height of the metacenter M (the distance from the center G of gravity to the metacenter M).

γs corresponds to an approximate value of the amplitude of single sway motion, and a moment lever l(K) is a value independent of the location of the center of gravity. Both γs and l(K) depend on the shape and motion frequency of the box-type floating body 1.

γs, a component of an effective wave slope coefficient, and the moment lever l(K) were calculated on the box-type floating body 1. The floating body l on which the calculations are made has six different values of B/d: 2.5, 5, 7.5, 10, 12.5 and 20. The two-dimensional velocity potential continuation method is used for calculation in which three-dimensional influence on a hydrodynamic force is not considered.

Calculated values of γs are shown in FIG. 2. The abscissa in FIG. 2 represents a non-dimensional frequency K(B/2) where $K=\omega^2/g$, $\omega=2\pi/T$, and ω and T are a frequency and wave period, respectively.

As shown in FIG. 2, γs flatly decreases as the frequency increases. γs changes a little with a change in the breadth/draft ratio of the box-type floating body 1; in shallow-draft box-type floating bodies having a B/d ratio of 5 or more, the values of γs may be regarded as similar.

FIG. 3 shows the relationship between the ratio of the moment lever l(K) to a half-breadth B/2, or l(K)/(B/2) (the ordinate), and the non-dimensional frequency K(B/2) (the abscissa) with B/d as a parameter. l(K)/(B/2) varies slightly against the frequency, but varies considerably with the breadth/draft ratio. The greater the B/d, the greater the absolute value of l(K)/(B/2). With B/d=5, l(K)/(B/d) is nearly zero, showing substantially no change against the frequency. The value of 1(K) is obtainable from FIG. 3 if both the breadth/draft ratio B/d and the wave frequency of a sea area where the floating structure is installed are given.

There are three fundamental ideas to reduce the motion of a box-type floating body in waves: increase in damping force, prolongation of the natural period of the motion and reduction in the wave exciting force. In the equation (1) of synchronized motion, reducing the wave exciting force means to make smaller the value of the right-hand side, which can be achieved by making γ·GM smaller as can be seen from Equation (2). Since γ·GM can be expressed as Equation (6), γ·GM=0 either when γs=0 at a certain frequency or when OG=l(K). In this paper reduction in roll motion is realized with this idea.

First, $H_2(K)=0$ is needed in order to have γs=0, which is theoretically achievable by selecting the shape of a floating body which has no sway waves. However, realistic shapes may not be obtainable for box-type floating bodies having larger breadth/draft ratios.

On the other hand, OG=l(K) may be achieved depending on the height OG of the center of gravity. Although it has been conventionally said that obtaining OG=l (K) is difficult for sea areas with relatively long wave lengths, such a case applies to ships with a general shape; and it is obtainable in box-type floating bodies having large breadth/draft ratios.

Realizing OG=l(K) through adjustment of the OG value may be achieved by, for example, making OG larger by installing a base on the box-type floating body to mount a heavy object on it. However, when OG is made larger, the value of GM becomes smaller, which may make the floating body unstable depending on its shape.

The present invention was made in view of the above and has its object to provide an anti-rolling structure for box-type floating bodies in which shapes of the box-type floating bodies are modified to adjust a value of moment lever l(K), thereby attaining OG=l(K) to reduce the wave exciting force.

BRIEF SUMMARY OF THE INVENTION

In order to solve the above-mentioned problems, the present invention provides an anti-rolling structure for a box-type floating body comprising said floating body which is substantially rectangular when seen from above and at least a protrusion on at least either of transverse sides of the floating body, said protrusion extending longitudinally of the floating body at a level lower than a waterline.

Preferably, said longitudinal protrusion extends over substantially an entire length of the floating body.

Said longitudinal protrusion may extend partially of the floating body.

Preferably, in addition to the longitudinal protrusion at the level lower than the waterline, a plurality of vertical protrusions are arranged on the floating body and are spaced apart from each other longitudinally of the floating body, each of said vertical protrusions having a protruded dimension substantially equal to that of the longitudinal protrusion.

Preferably, the longitudinal protrusion is shaped such that height of center of gravity of the floating body substantially coincides with a moment lever acting on the floating body.

Preferably, the longitudinal protrusion is at a lower edge of the box-type floating body.

An operation of the invention will be described. A moment lever l(K) acting on a floating body, which depends on different factors such as an added mass synchronous coefficient of sway motion of the floating body and wave exciting force, can be obtained, as explained with FIG. 3, from the graph when the frequency is given with the breadth/draft ratio B/d as a parameter. With respect to an average frequency or period of waves in a sea area in which a floating body such as a hull of a work-ship or a hull for FPSO is installed, a value of the moment lever l(K) thus obtained does not usually coincide with height OG of the center of gravity except accidental coincidence. The value of OG may be adjusted to make it have the same value as or close to that of the moment lever, but such a way is not always practical. In the present invention, at least a longitudinal protrusion is provided on at least either of transverse sides of a box-type floating body at a level lower than a waterline to thereby adjust the moment lever l(K) to a value same as or close to that of OG. As a result, the wave exciting force is reduced for less roll motion of the box-type floating body.

DETAILED DESCRIPTION OF THE PREFERRED EMBODIMENTS

Figure 1:
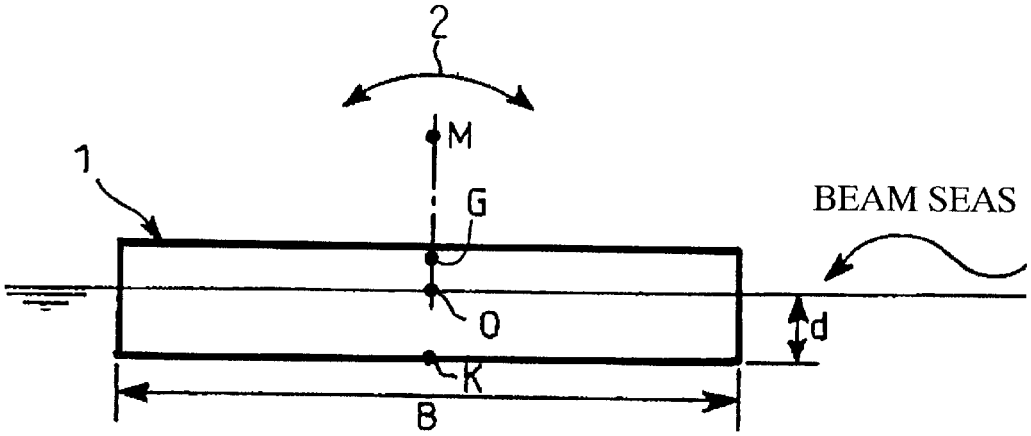
FIG. 1 PRIOR ART
FIG. 1 shows a rear view of a conventional box-type floating body.
Figure 2:
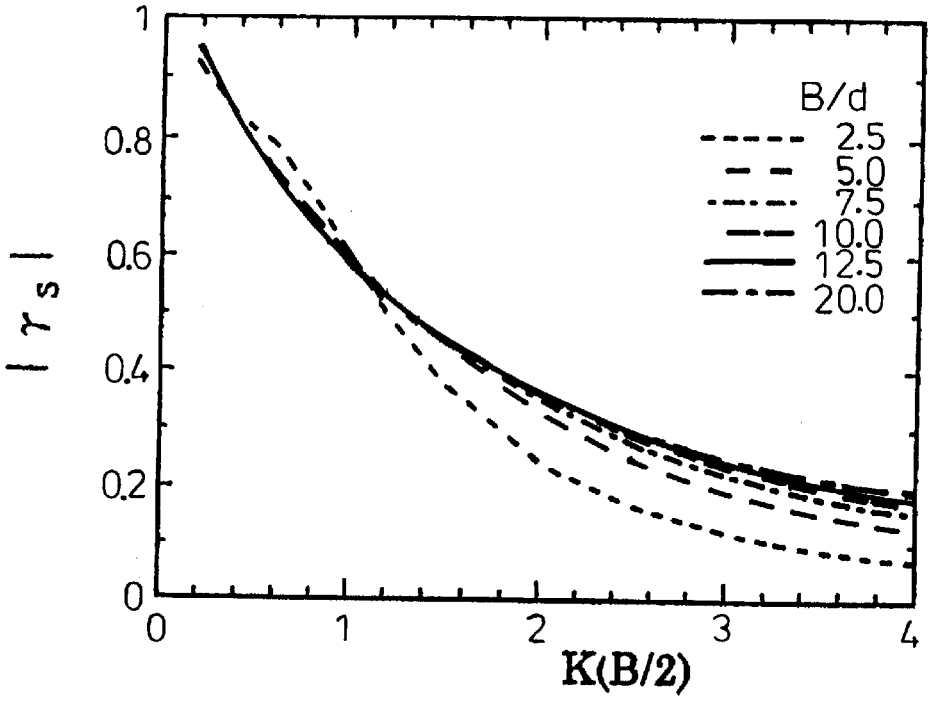
FIG. 2 PRIOR ART
FIG. 2 is a graph showing the relationship between γs and non-dimensional frequency of the conventional box-type floating body.
Figure 3:
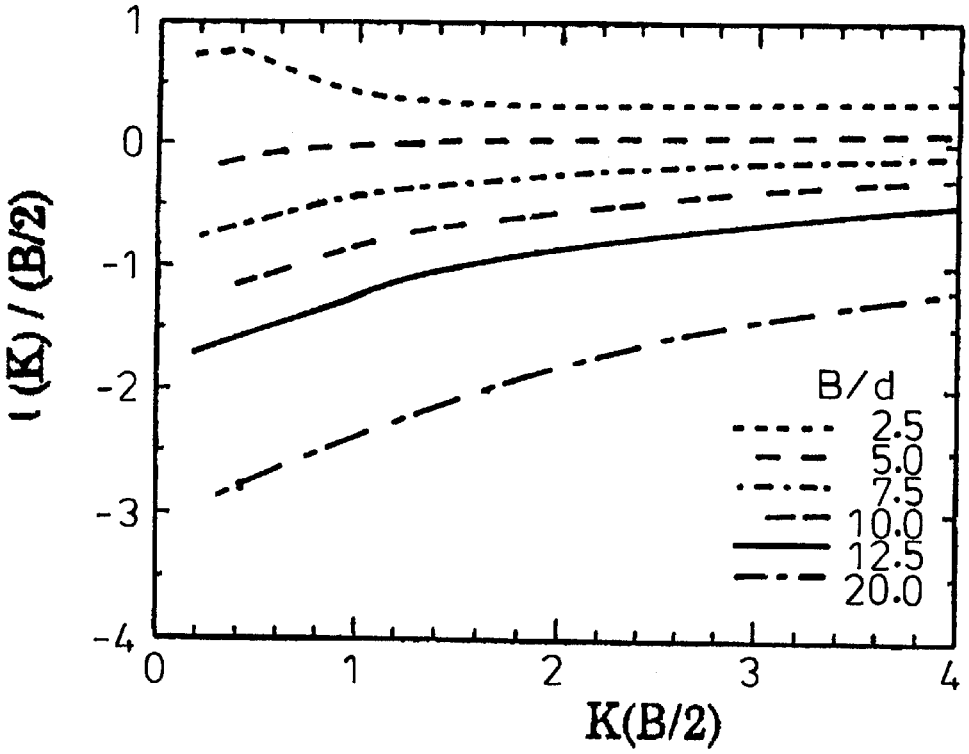
F I G. 3 PRIOR ART
FIG. 3 is a graph showing the relationship between a moment lever l(K) and non-dimensional frequency of the conventional box-type floating body.
Figure 4A:
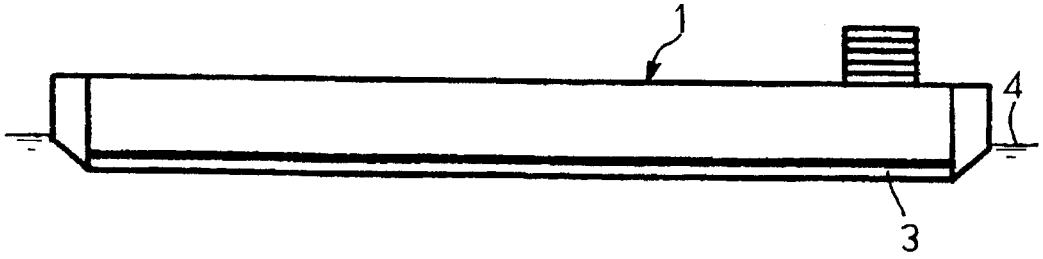
FIGS. 4A, 4B and 4C show side, plan and front views of an anti-rolling structure for a box-type floating body in accordance with the present invention, respectively.
Figure 4B:
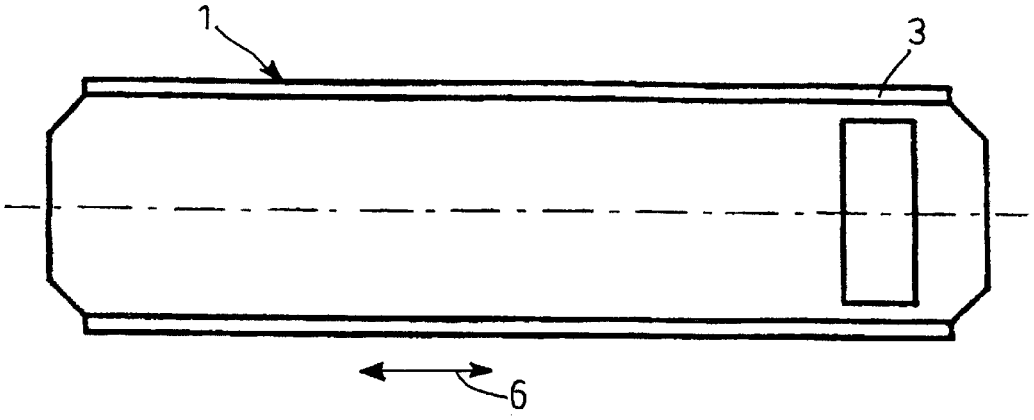
Figure 4C:
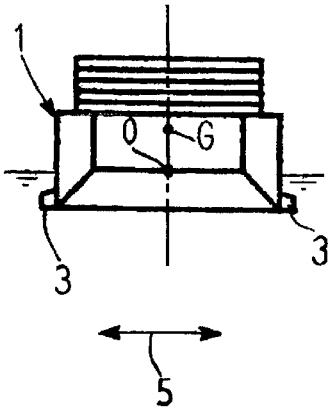

An embodiment of the invention will be described with reference to the accompanying drawings. FIGS. 4A, 4B and 4C are side, plan and front views of an anti-rolling structure for a box-type floating body in accordance with the invention, respectively. Reference numerals same as those in FIG. 1 are used to designate similar parts throughout the figures. In the figures, reference numeral 1 denotes a box-type floating body of a work-ship or for FPSO. The floating body 1 is rectangular when seen from above and has a flat bottom. Protrusions 3 are attached to both sides in a transverse direction 5 of the floating body 1 and extend substantially over the entire length in a longitudinal direction 6 of the floating body 1 at a level lower than a waterline 4. The protrusions 3 in the figures are shown to be at lower edges of the floating body 1; they may be, however, arranged at positions other than the lower edges.

Preferably, the protrusions 3 are shaped such that height OG of center of gravity of the floating body substantially coincides with the moment lever l(K) acting on the floating body.

Figure 5:
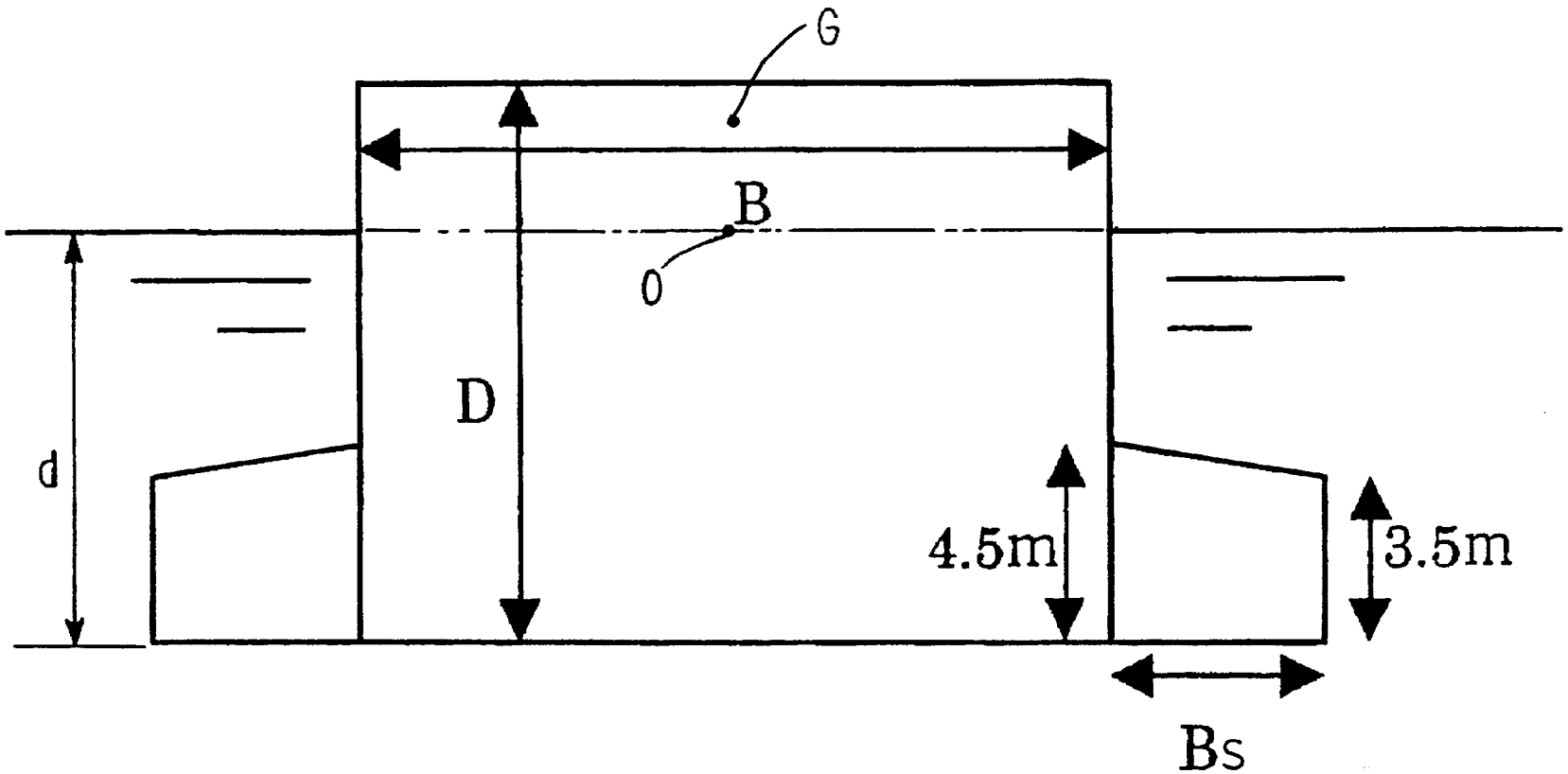
FIG. 5 shows a vertical section of a hull for FPSO taken at the center in the longitudinal direction.

Next, a result of calculations for a specific example will be described. FIG. 5 is a view showing a transverse section, taken at the center in the longitudinal direction, of a hull for FPSO under planning; this is presented as a specific example of the anti-rolling structure of the invention. The FPSO hull has a length of 295 m, a breadth B of 60 m and a height D of 25 m. The draft depth d is 9 m for a case without protrusions, and 8.47 m for a case with protrusions of the maximum protruded dimension. The height OG of the center of the gravity is −8.16 m, where OG is negative when G is located above a water surface O. Thus, OG/(B/2)=−0.272 is obtained. The calculations were made with the different protruding dimension Bs: Bs=0, Bs=1 m, Bs=2 m, Bs=3 m, and Bs=4 m.

Figure 6:
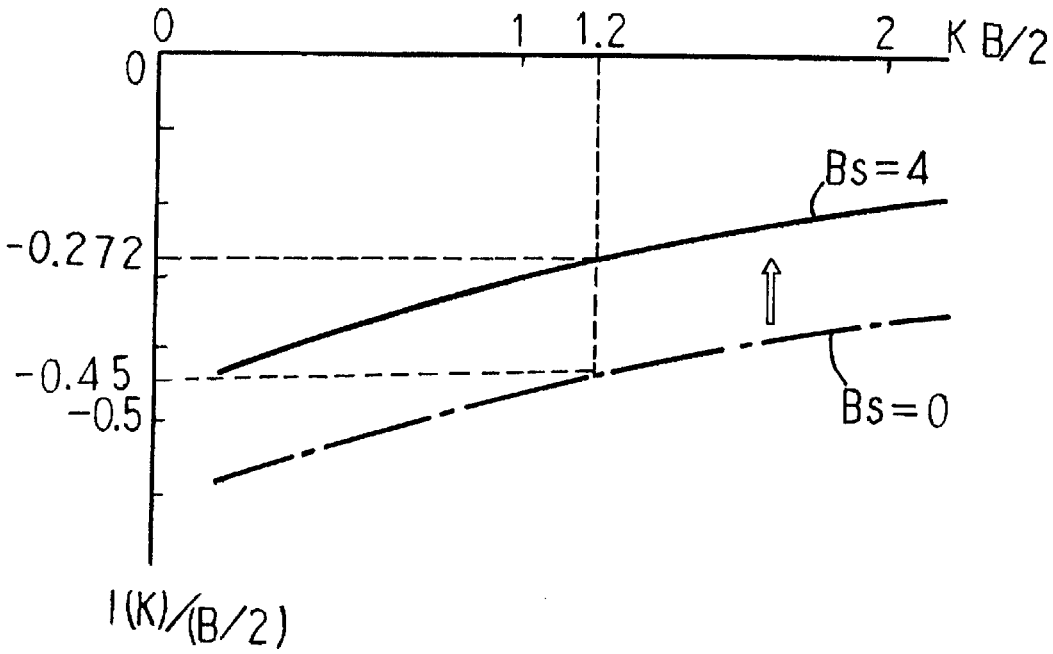
FIG. 6 is a graph showing the relationship between the moment lever and frequency of the floating body shown in FIG. 5.

Since the average wave period in a sea area where the box-type floating body 1 is planned to be installed is 10 sec, it is so arranged that the maximum roll reducing effect should be obtained at this wave period. FIG. 6 is a graph showing the relationship between the ratio of the moment lever l(K) to a half-breadth B/2, or l(K)/(B/2) (the ordinate) and non-dimensional frequency K(B/2) (the abscissa) of the box-type floating body (B/d=6.67) shown in FIG. 5. The dashed line denotes Bs=0, a box-type floating body without the protrusions 3, and the continuous line denotes the graph for a box-type floating body with the protrusions 3 having Bs=4 m. When T=10 sec, K(B/2)=1.2, and, as understood from FIG. 6, l(K)/(B/2) is approximately −0.45 in a box-type floating body having Bs=0. With the protrusions 3 having Bs=4, l(K)/(B/2) becomes −0.272 for the average wave period of 10 sec, and thus OG=l(K) is realized.

Figure 7A:
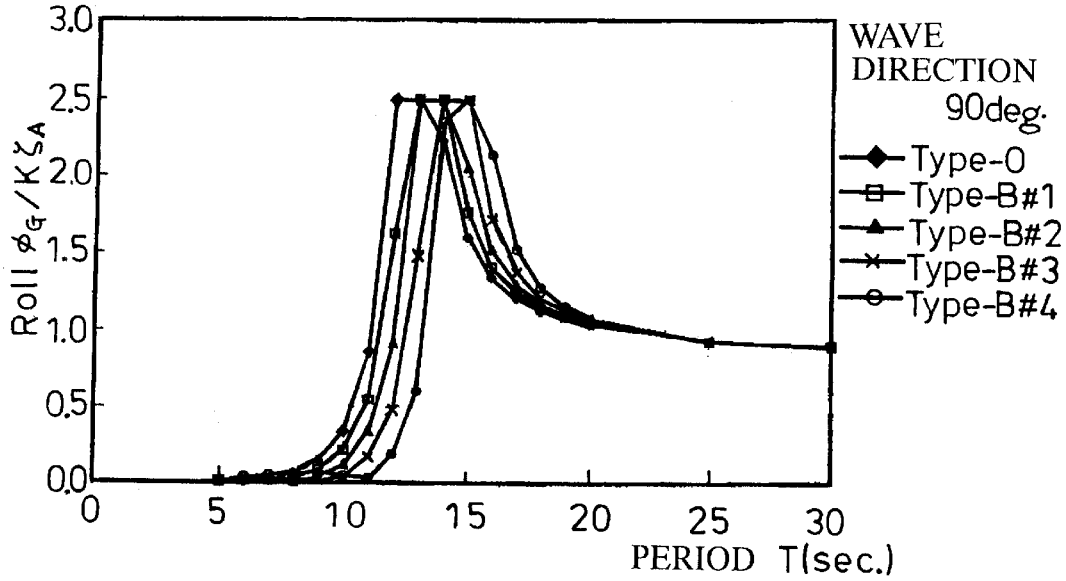
FIGS. 7A and 7B are graphs showing roll reducing effect when $B_s$ is varied from 0 through 4 m in the floating body shown in FIG. 5, the former representing the relationship between the roll response function and wave period and the latter representing the relationship between a result of the roll short-term assumption and average wave period.
Figure 7B:
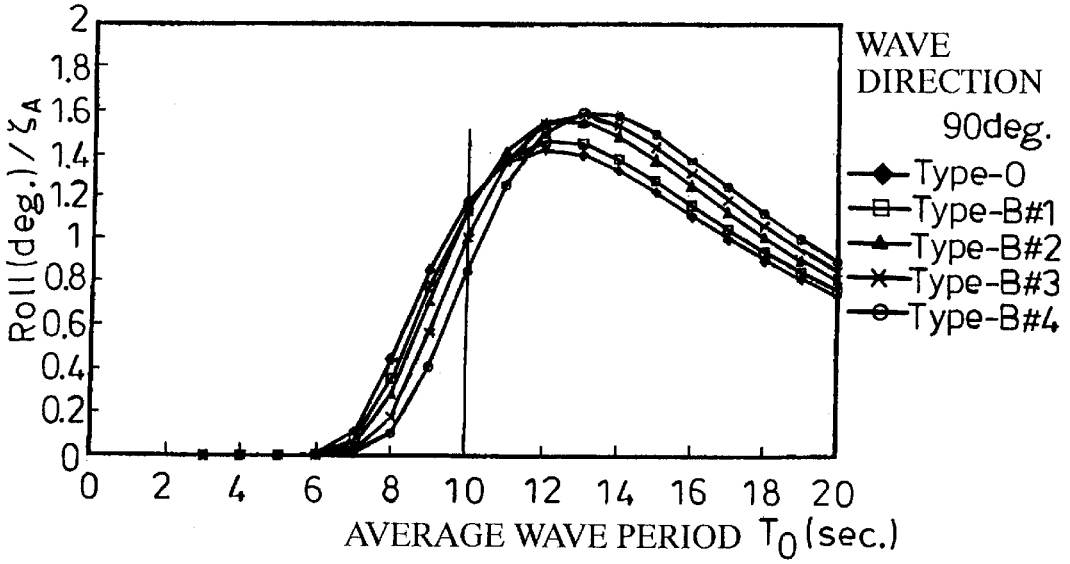

FIG. 7A is a graph showing roll reducing effect when Bs is varied from 0 through 4, representing the relationship between the roll response function and wave period. FIG. 7B represents the relationship between a result of the roll short-term assumption and average wave period. In the diagrams, Type-O represents Bs=0; Type-B#1, Bs=1; Type-B#2, Bs=2; Type-B#3, Bs=3; and Type-B#4, Bs=4. As seen in FIG. 7A, the synchronous period at which the response of roll motion reaches the maximum becomes larger as Bs varies from 0 through 4. It is understood from FIG. 7B that, when the average wave period of an intended sea area of the installation is 10 sec, roll motion is considerably suppressed by setting the protrusions 3 as Bs=4 m. Adding protrusions to those used for the calculations above can further reduce roll motion since when an increase in the added mass of roll motion occurs an effect of viscous damping can also be expected.

Figure 8:
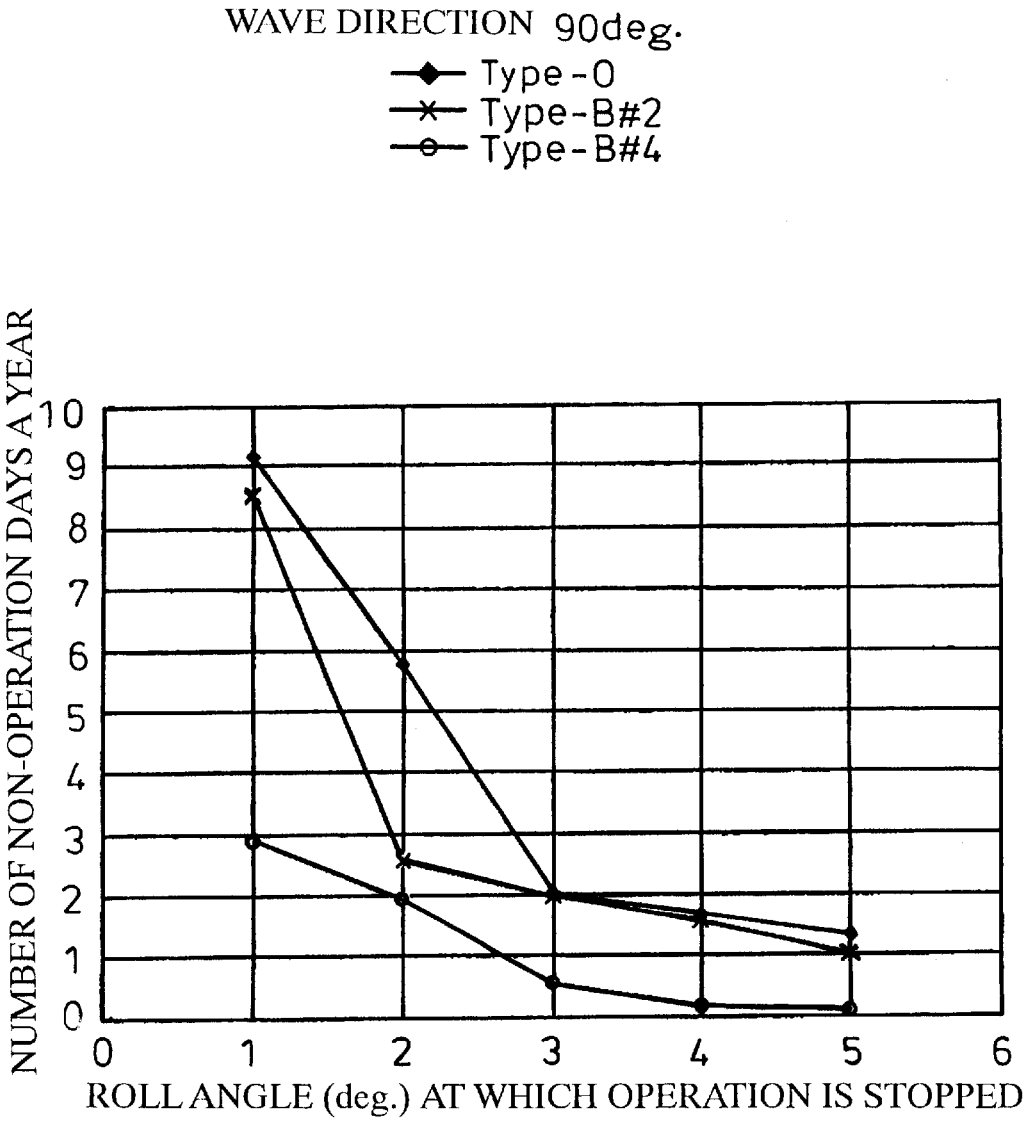
FIG. 8 is a graph showing, with respect to the floating body shown in FIG. 5, the relationship between the number of non-operation days a year and roll angle of the floating body at which operation is stopped.

FIG. 8 is a diagram showing the relationship, in oceanographic phenomena in an intended sea area of the installation, between the number of non-operation days a year (the ordinate) and roll angle of the floating body at which operation is stopped (the abscissa), wherein the cases of Bs=0, Bs=2 and Bs=4 are indicated. When the angle at which the operation of plants, etc. are stopped is set at 5 degrees, conventional structures (Bs=0) have about 9 non-operation days a year, while a structure of the present invention (Bs=4) has about 3 non-operation days a year, showing remarkable improvement.

Figure 9A:
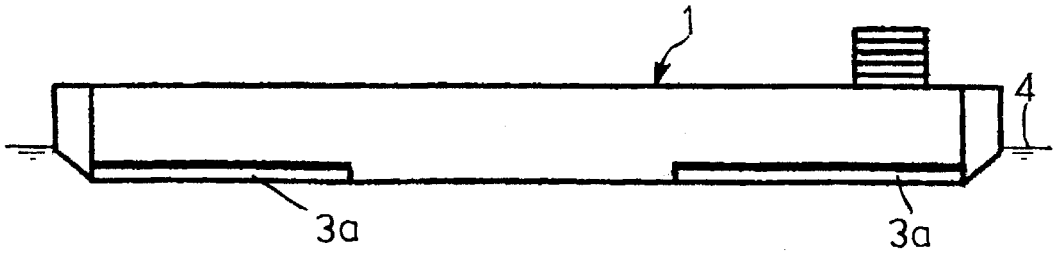
FIGS. 9A, 9B and 9C show side, plan and front views of a modification of an anti-rolling structure for a box-type floating body in accordance with the invention, respectively.
Figure 9B:
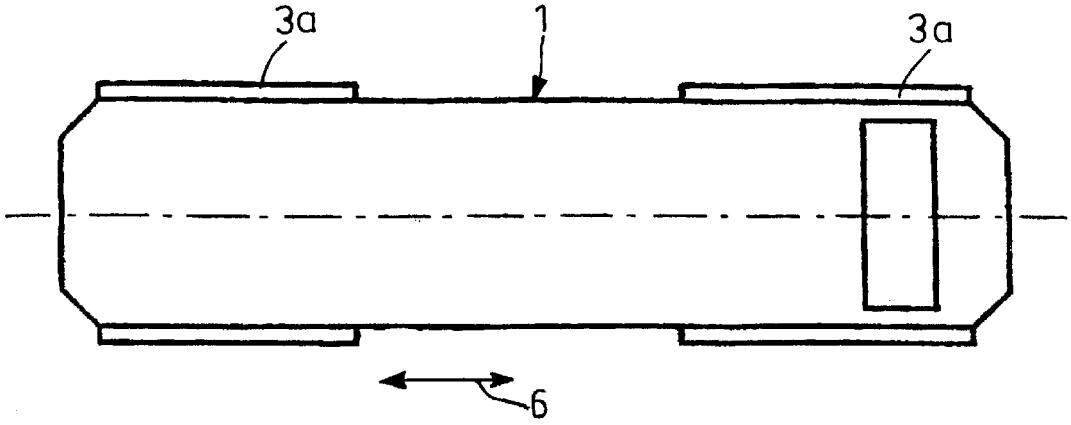
Figure 9C:
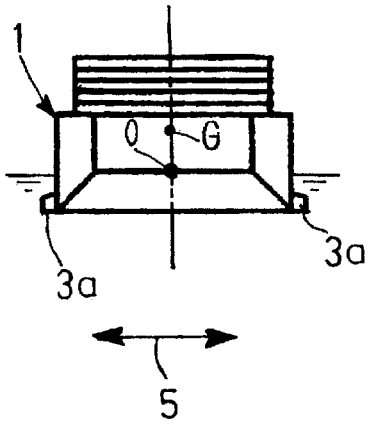
Figure 13:
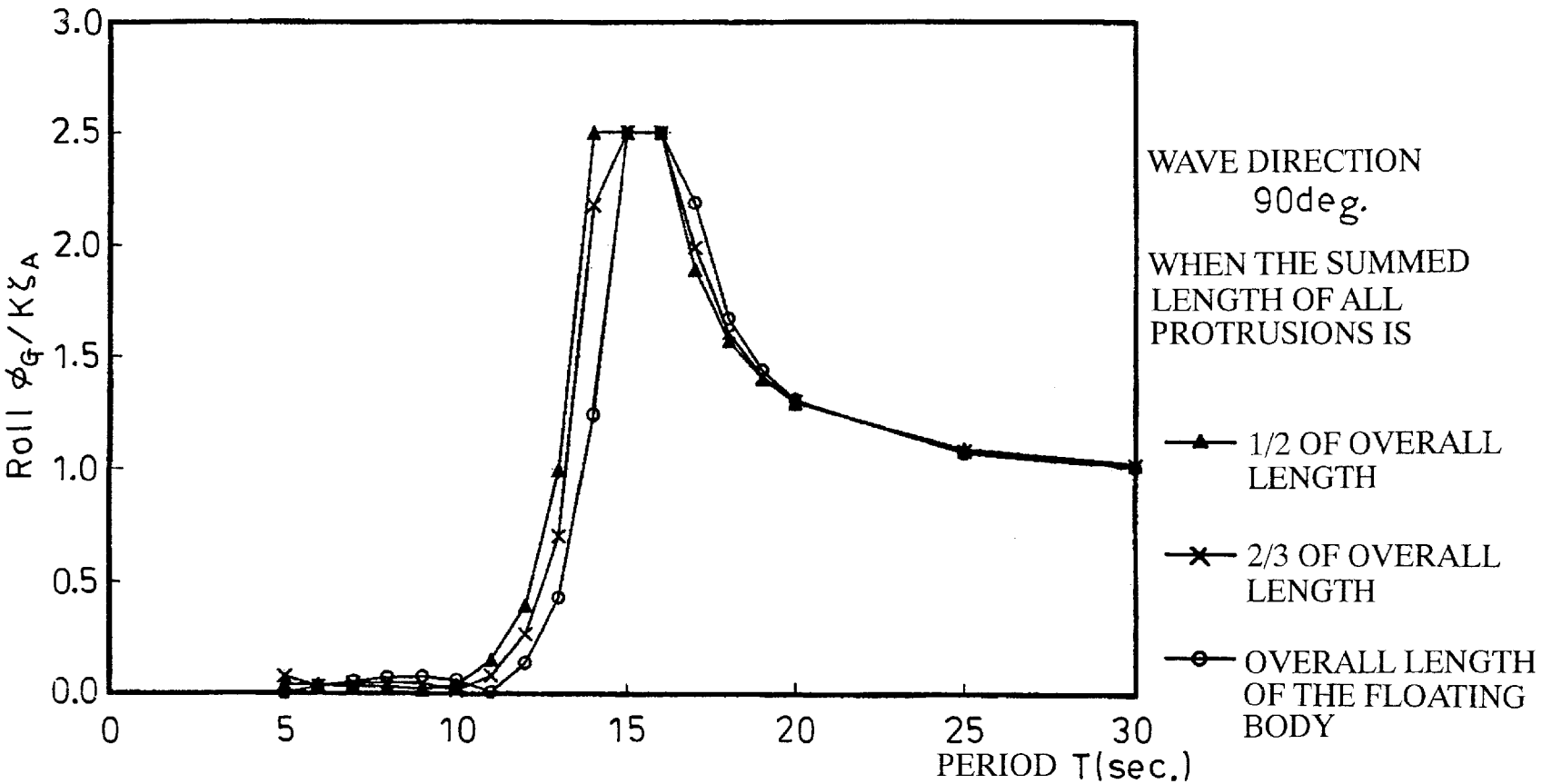
FIG. 13 is a graph showing roll reducing effect of the box-type floating body shown in FIG. 5, where Bs is set at 4 m and summed total length of the protrusions is ½ of, ⅔ of, and equal to the overall length of the floating body, representing the relationship between the roll response function and wave period.

Modifications of the invention will be described referring to the accompanying drawings. FIGS. 9A, 9B and 9C show a modification of the invention in which longitudinal protrusions extend partially on both transverse sides of the box-type floating body 1. Partial longitudinal protrusions 3*a*, each having a length of ⅓ of the overall length of the floating body, are attached to front and rear portions of the box-type floating body 1. FIG. 13 is a graph showing the relationship between the roll response function and wave period when the summed length of all the longitudinal protrusions 3*a* is ½ (case 1) of, ⅔ (case 2) of and equal (case 3) to the overall length of the floating body 1. The protruded dimension in the drawing is Bs=4. Comparing the case of Bs=4 in FIG. 13 with that of Bs=0 in FIG. 7A, it is understood that, in each of the cases 1, 2 and 3 in FIG. 13, the synchronous periods at which roll response reaches the maximum is larger than those shown in FIG. 7A. It is also seen in the same diagram that there is a little difference between the case where the summed length of all the protrusions 3*a* in the longitudinal direction is ⅔ of the overall length and the case where the summed length is equal to the overall length of the floating body 1.

Figure 10A:
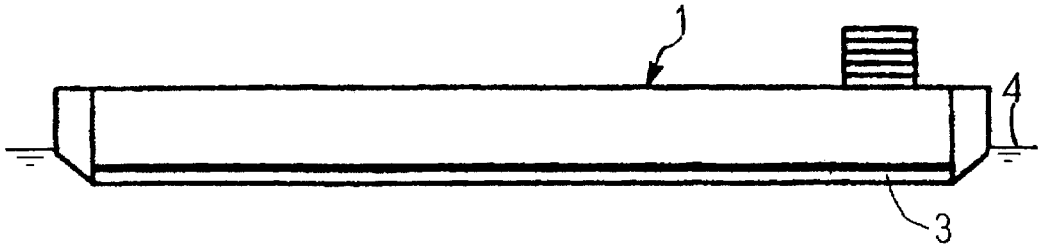
FIGS. 10A, 10B and 10C show side, plan and front views of a further modification of an anti-rolling structure for a box-type floating body in accordance with the invention, respectively.
Figure 10B:
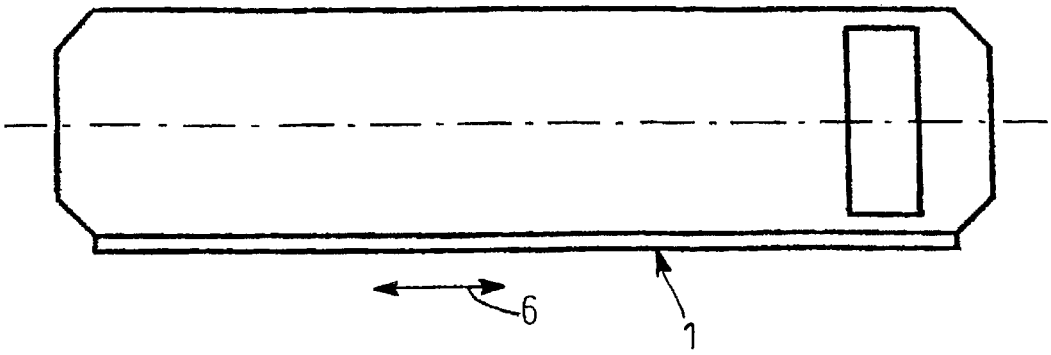
Figure 10C:
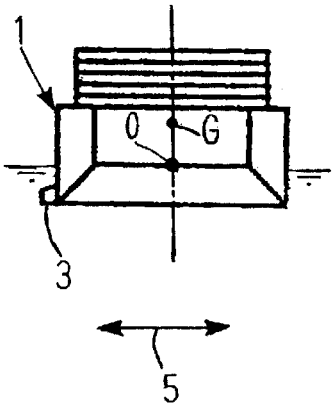

FIGS. 10A, 10B and 10C show a further modification of the invention in which the single longitudinal protrusion 3 is attached only to one of the transverse sides of the box-type floating body 1. This is advantageous when the center G of gravity of the floating body 1 is eccentric.

Figure 11A:
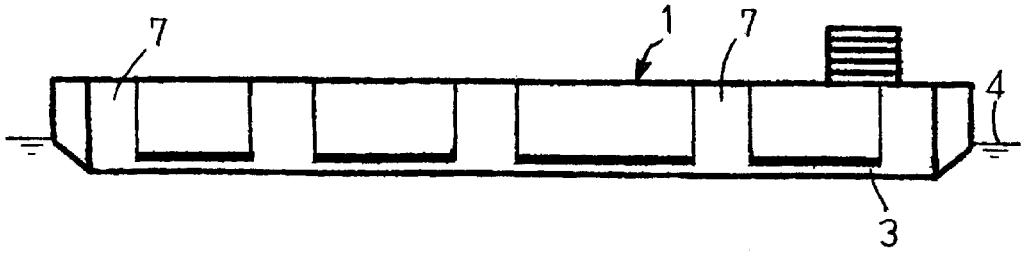
FIGS. 11A, 11B and 11C show side, plan and front views of a still further modification of an anti-rolling structure for a box-type floating body in accordance with the invention, respectively.
Figure 11B:
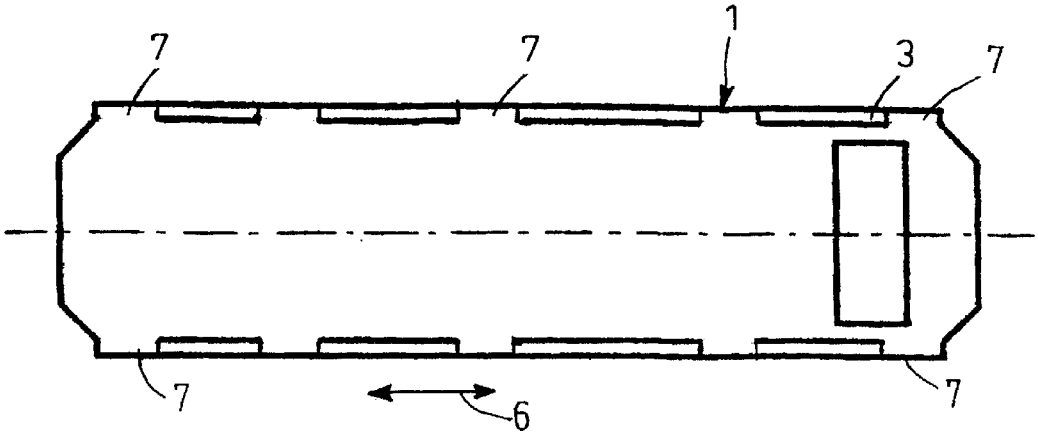
Figure 11C:
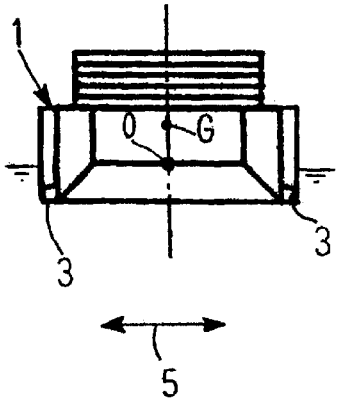
Figure 12:
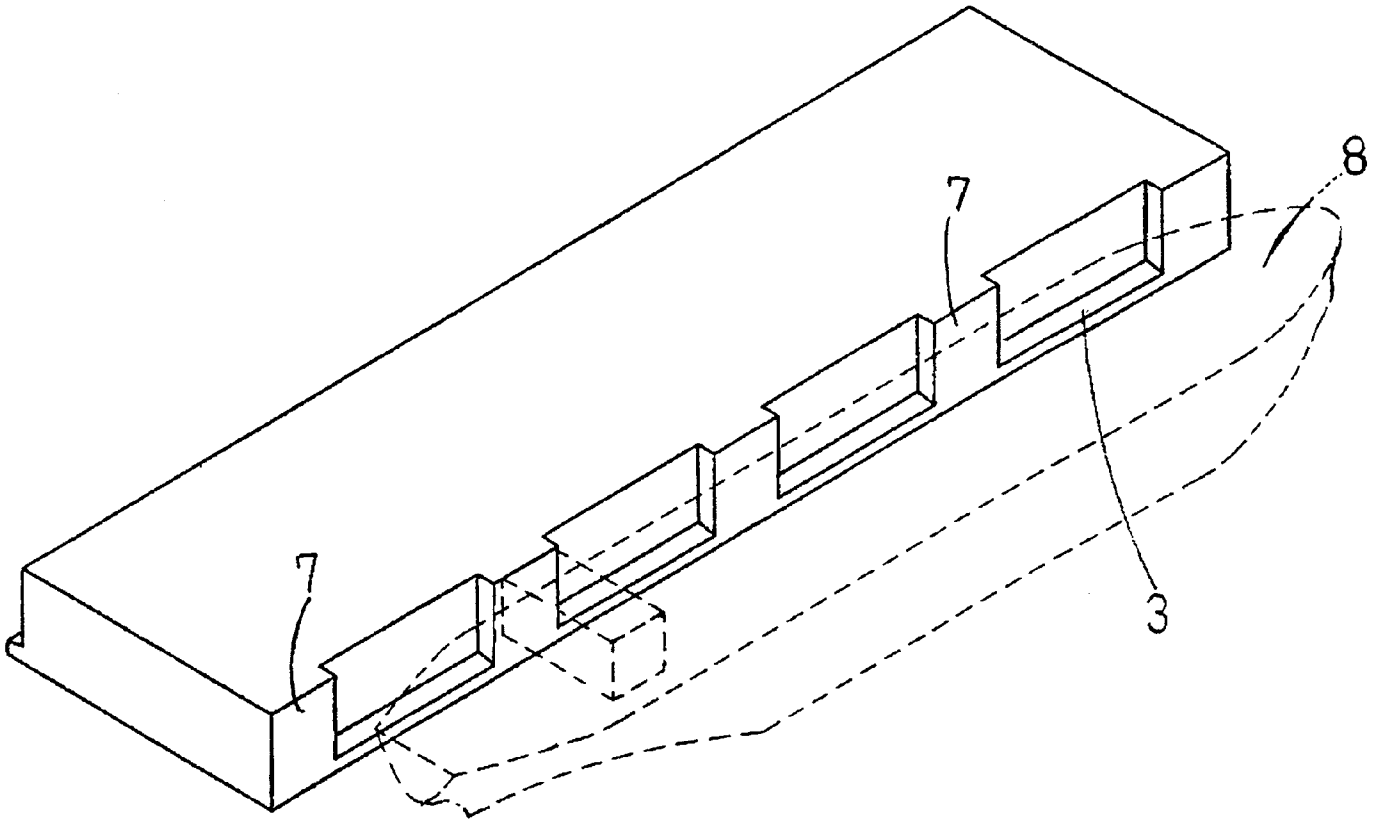
FIG. 12 is a perspective view showing the still further modification with a ship or vessel being brought alongside the floating body.

FIGS. 11A, 11B and 11C show a still further modification of the invention in which a plurality of vertical protrusions 7 (5 pieces in the example), each having an substantially equal protruded dimension Bs, are installed in addition to the longitudinal protrusions 3 at the level lower than the waterline. FIG. 12 is a perspective view showing that a vessel 8 is brought alongside the box-type floating body 1.

When the box-type floating body 1 is provided only with the longitudinal protrusions 3, the protrusions 3 and the vessel 8 may collide with each other even if fenders are placed between the vessel 8 and the floating body 1 since the vessel 8, which is brought alongside the floating body 1, may have roll period and phase different from those of the floating body 1. However, when the floating body 1 is provided also with the vertical protrusions 7 and fenders are attached to the protrusions 7, the vessel 8 can safely come alongside the floating body 1.

It is to be understood that the present invention is not limited to the embodiments and modifications described above and that various changes and further modifications may be made without deviating from the scope and spirit of the invention. For example, it has been described that protrusions are attached to a box-type floating body as additional objects; but box-type floating bodies may be formed to have protrusions integral therewith. The shapes of the protrusions do not necessarily need to achieve OG=l(K). Satisfying required specifications by bringing l(K) closer to OG may also be a solution. Furthermore, the shape of the box-type floating body is to be substantially rectangular when seen from above; both longitudinal ends of the floating body may be a trapezoidal as shown in FIGS. 4A, 4B and 4C or semi-circular shape.

As described above, the anti-rolling structure for a box-type floating body according to the invention offers a simple structure with protrusions below the waterline. It provides an excellent effect to remarkably reduce the roll motion of box-type floating body in an intended sea area of installation.

What is claimed is:

1. An anti-rolling structure for a box-type floating body comprising said floating body which is substantially rectangular when seen from above and at least a protrusion on at least either of transverse sides of the floating body, said protrusion extending longitudinally of the floating body at a level lower than a waterline so as to adjust a moment lever l(K) to a value at least close to that of distance OG from an origin O lying at the waterline to center G of gravity, the moment lever l(K) being given by an equation $$l(K)=k_2 l_{20}-(1+k_2)l_{wo}$$

where $k_2$ define an added mass coefficient of sway motion, $l_{20}$ defines a hydrodynamic force moment lever, and $l_{wo}$ defines a wave exciting moment lever about the origin O.

2. An anti-rolling structure according to claim 1 wherein said protrusion extends over substantially an entire length of the floating body.

3. An anti-rolling structure according to claim 1 wherein said protrusion extends partially of the floating body.

4. An anti-rolling structure according to any one of claims 1 to 3 wherein, in addition to the longitudinal protrusion at the level lower than the waterline, a plurality of vertical protrusions are arranged on the floating body and are spaced apart from each other longitudinally of the floating body, each of said vertical protrusions having a protruded dimension substantially equal to that of the longitudinal protrusion.

5. An anti-rolling structure according to any one of claims 1 to 3 wherein said longitudinal protrusion is shaped such that height of center of gravity of the floating body substantially coincides with a moment lever acting on the floating body.

6. An anti-rolling structure according to claim 4 wherein said longitudinal protrusion is shaped such that height of center of gravity of the floating body substantially coincides with a moment lever acting on the floating body.

7. An anti-rolling structure according to any one of claims 1 to 3 wherein said longitudinal protrusion is at a lower edge of the floating body.

8. An anti-rolling structure according to claim 4 wherein said longitudinal protrusion is at a lower edge of the floating body.

9. An anti-rolling structure according to claim 5 wherein said longitudinal protrusion is at a lower edge of the floating body.

* * * * *